United States Patent [19]

Richardson et al.

[11] 4,149,596

[45] Apr. 17, 1979

[54] METHOD FOR RECOVERING GAS FROM SOLUTION IN AQUIFER WATERS

[75] Inventors: Joseph G. Richardson; Lawrence D. Christian, both of Houston, Tex.

[73] Assignee: Exxon Production Research Company, Houston, Tex.

[21] Appl. No.: 905,921

[22] Filed: May 15, 1978

Related U.S. Application Data

[63] Continuation of Ser. No. 786,736, Apr. 11, 1977, abandoned.

[51] Int. Cl.[2] ..... E21B 43/00

[52] U.S. Cl. ..... 166/267; 166/314

[58] Field of Search ..... 166/267, 314, 268, 263, 166/265, 250

[56] References Cited

U.S. PATENT DOCUMENTS

| | | | |
|---|---|---|---|
| 1,439,391 | 12/1922 | Alldredge | 166/267 |
| 3,134,434 | 5/1964 | Wooddy, Jr. | 166/263 |
| 3,215,198 | 11/1965 | Willman | 166/263 |
| 3,258,069 | 6/1966 | Hottman | 166/252 |
| 4,040,487 | 8/1977 | Cook, Jr. et al. | 166/314 |
| 4,042,034 | 8/1977 | Cook, Jr. et al. | 166/314 |

*Primary Examiner*—Stephen J. Novosad
*Attorney, Agent, or Firm*—J. S. Schneider

[57] ABSTRACT

In a method for producing hydrocarbon gas from aquifers which contain gas in water solution, water is produced from wells distributed through the aquifer and solution gases are recovered from the produced water. The aquifer pressure declines as production continues; gas comes out of water solution and a gas phase saturation builds up in the aquifer. When gas saturation exceeds a critical value, gas in gaseous phase flows through the aquifer rock to the producing wells and the ratio of total gas to total water produced increases substantially.

5 Claims, 3 Drawing Figures

METHOD FOR RECOVERING GAS FROM SOLUTION IN AQUIFER WATERS

This is a continuation, of application Ser. No. 786,736, filed Apr. 11, 1977, now abandoned.

BACKGROUND OF THE INVENTION

The present invention concerns a method for producing hydrocarbon gas from subterranean aquifers and, particularly, for producing hydrocarbon gas initially in water solution in the aquifers.

Waters in a large number of aquifers throughout the world contain very large quantities of gas in water solution. Aquifer waters underlying the Texas-Louisiana coastline were estimated to potentially contain about 50 thousand trillion cubic feet of gas. (See "Natural Gas Resources of Geopressured Zones in the Northern Gulf of Mexico Basin" by P. H. Jones presented at the "Forum on Potential Resources of Natural Gas" at Louisiana State University, Baton Rouge, La., on Jan. 15, 1976).

The effect of pressure, temperature and water salinity on solubility of natural gas in water is well known (as, for example, described in an article entitled "pressure-Volume-Temperature and Solubility Relations for Natural Gas-Water Mixtures" by C. R. Dodson and M. B. Standing, Drilling and Production Practice, API, 1944). Of the parameters which affect the amount of gas which can be in water solution pressure is the most important. At depths of about 15,000 feet, "geopressured" aquifers along the Texas-Louisiana Gulf Coast typically have pressure on the order of 13,000 psig and the water contains on the order of 30 standard cubic feet (scf) or more of solution gas per barrel (B).

Aquifer waters can also contain less gas in solution than that corresponding to saturation, in which case they are "undersaturated". It is well known that water resident in certain geological formations in certain geographic areas almost always contains gas in solution closely corresponding to "saturated" conditions.

Aquifer waters with hydrocarbon gas in solution at saturation levels, or near saturation levels, are most suitable for application of the present invention.

SUMMARY OF THE INVENTION

A method for producing hydrocarbon gas from aquifers which contain gas in water solution in which water is produced from wells completed in the aquifer. Continued production of water results in pressure decline causing gas to evolve from the water in the aquifer. That gas migrates to the wells and is produced with the water.

Initially, gas in solution in aquifer water is produced with the water and recovered by surface separation. Continued production causes gas saturation in the aquifer to build up to a level such that gas phase gas flows from the aquifer into wells along with aquifer water. Gas recovered at the surface is the sum of gas in solution in produced water plus produced gas phase gas.

DESCRIPTION OF THE PREFERRED EMBODIMENTS

In accordance with the invention, water is produced from wells completed in the aquifer. As water is removed from the aquifer the rock's pore space in which the produced water initially resided is filled by (1) expansion of the aquifer rock, (2) expansion of the water remaining in the aquifer and (3) gas which comes out of water solution. Pressure in the aquifer declines by an amount commensurate with effecting the required expansions.

Figure 1:
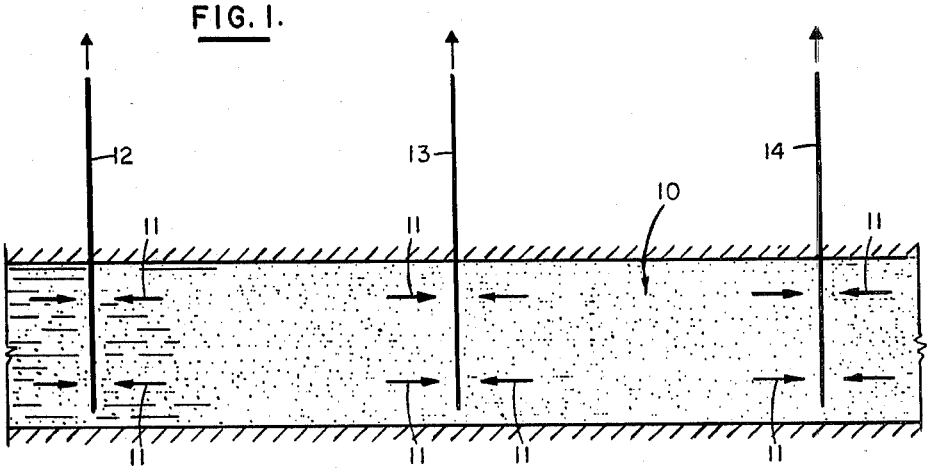
FIGS. 1, 2 and 3 illustrate application of the present invention to a typical aquifer.

In FIG. 1 an aquifer 10 is shown in which are completed wells 12, 13 and 14. When production is initiated, aquifer water containing solution gas flows to and is produced from the aquifer wells, as indicated by arrowed lines 11. Gas in solution in the water which enters the wells is produced and recovered by conventional surface gas-water separation techniques.

Figure 2:
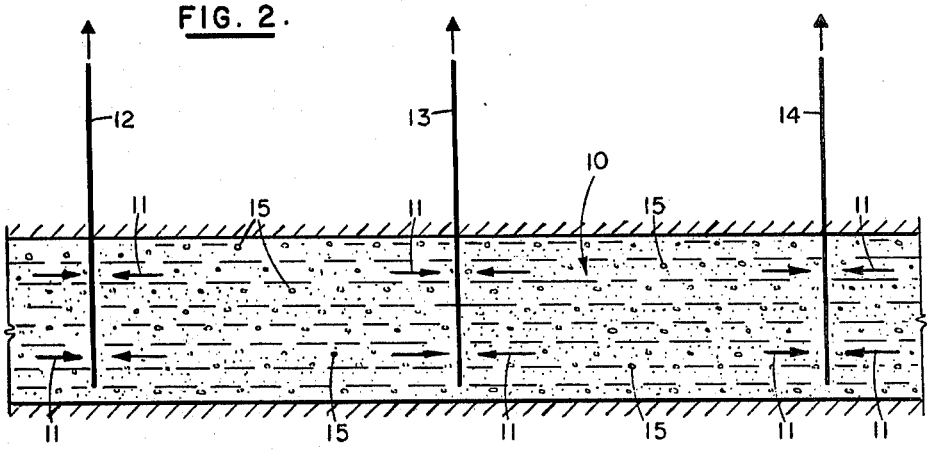

Intermediate conditions in the aquifer are illustrated in FIG. 2. Continued water production through wells 12, 13 and 14, again indicated by arrowed lines 11, has reduced aquifer pressure. Gas, indicated by globules 15, has evolved from saturation in aquifer water and is accumulating as gas phase saturation in the aquifer rock. Gas phase saturation has not as yet built up to "critical gas saturation" required for gas phase flow through aquifer rock.

Figure 3:
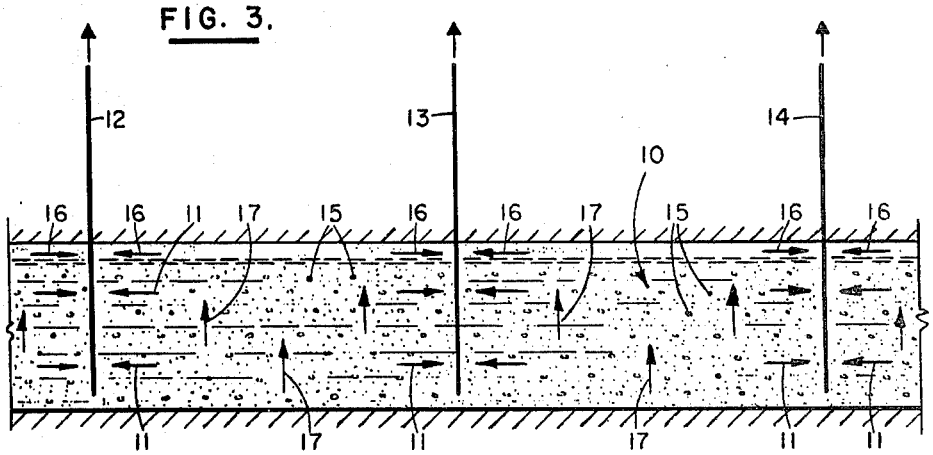

In FIG. 3 late (gas phase flow) conditions are illustrated. Production of water containing gas in solution from wells 12, 13 and 14 is continued and reservoir pressure drops to a level well below the initial level, for example, 15 percent of the initial pressure. Water flow to the wells is again indicated by arrowed lines 11. Gas phase gas also flows to the wells, mostly as a thin layer along the top of permeable aquifer rock, as indicated by arrowed lines 16. The thin layer of gas flowing rapidly along the top is replenished by gas segregating to the top of the aquifer by gravity forces, as indicated by arrowed lines 17. Gas saturation in most of the aquifer is slightly above the critical gas saturation at which gas flow commences. Production of gas and water from the aquifer is continued until aquifer pressure becomes so low that gas production is not economic.

In certain structures the dip may be substantial and gravity segregation may greatly aid the flow of the gaseous phase upstructure. If sufficient gas accumulates in structural highs wells may be properly spaced in such structures for producing only gas evolved from water solution and no water.

Tables I and II, below, show calculated gas evolved and buildup of gas saturation with production induced pressure decline in two typical aquifers. The gas saturations were calculated on the basis that no gas phase flow will take place. The Table I results are for a Texas Gulf Coast geopressured aquifer at 15,000 feet depth. The aquifer water initially contains 30 scf/B of solution gas at 12,975 psig pressure. The Table II results are for a Texas Gulf Coast normally pressured aquifer at 6600 feet depth. This aquifer's water initially contains 13.9 scf/B at 3000 psig.

TABLE I

GAS EVOLUTION AND GAS SATURATION BUILDUP AS PRESSURE DECLINES IN A GEOPRESSURED SAND

| Pressure psi | Solution Gas Evolved, scf/B | $S_g$* Fraction |
|---|---|---|
| 12,975 | 0 | 0 |
| 12,000 | 2.3 | 0.0011 |

TABLE I-continued

GAS EVOLUTION AND GAS SATURATION BUILDUP AS PRESSURE DECLINES IN A GEOPRESSURED SAND

| Pressure psi | Solution Gas Evolved, scf/B | $S_g$* Fraction |
|---|---|---|
| 11,000 | 4.6 | 0.0023 |
| 10,000 | 6.9 | 0.0037 |
| 9,000 | 9.2 | 0.0052 |
| 8,000 | 11.5 | 0.0070 |
| 7,000 | 13.8 | 0.0092 |
| 6,000 | 16.1 | 0.0119 |
| 5,000 | 18.4 | 0.0155 |
| 4,000 | 20.8 | 0.0208 |
| 3,000 | 23.1 | 0.0298 |
| 2,000 | 25.4 | 0.0481 |
| 1,000 | 27.7 | 0.1052 |

*Average gas saturation assuming no gas production

TABLE II

GAS EVOLUTION AND GAS SATURATION BUILDUP AS PRESSURE DECLINES IN A MODERATE DEPTH NORMALLY PRESSURED WATER SAND

| Pressure psi | Solution Gas Evolved, scf/B | $S_g$* Fraction |
|---|---|---|
| 3,000 | 0 | 0 |
| 2,500 | 2.0 | 0.0024 |
| 2,000 | 4.0 | 0.0061 |
| 1,500 | 6.0 | 0.0122 |
| 1,000 | 8.0 | 0.0248 |
| 750 | 9.0 | 0.0374 |
| 500 | 10.0 | 0.625 |
| 250 | 11.0 | 0.136 |

*Average gas saturation assuming no gas production

Table I and II show that substantial gas saturation will build up if it is not reduced by gas flow from the aquifer. Laboratory data and field performance of a large number of oil fields show that as gas is evolved in rock pore spaces from solution in liquid (or liquids in the case of oil reservoirs containing oil and connate water), the initial gas evolved is held by capillary forces in the larger pore spaces and will not flow with pressure gradients which can practically be effected. As the gas saturation increases, it reaches a "critical" level at which flow will commence. This "critical gas saturation" will be about 3 percent in most aquifer rocks. Tables I and II show that critical gas saturation will be reached at just below 3000 psig in the Table I aquifer and at about 875 psig in the Table II aquifer. When water is produced from aquifers such as those denoted by Tables I and II all but about 1 scf/B of the gas in solution in the aquifer water plus any "gas phase" gas can be recovered by producing the well effluent through a conventional surface gas-liquid separator operated at about 100 psig pressure. Gas from the separator can be utilized in the same manner as gas from conventional oil and gas field operations and water from the separator can be disposed of by using known procedures normal to oil and gas field operations.

When production from an aquifer is initiated, gas produced per barrel of produced water will correspond to the initial solution level in the aquifer. The produced gas-water ratio will then decline in accordance with the solution ratio in the aquifer (initial solution ratio less gas evolved) until the critical gas saturation is reached in the aquifer rock. After the critical gas saturation is reached both gas phase and water will flow into wells and the produced gas-water ratio will be the sum of gas phase gas entering the well and gas in solution in water entering the well. Gas flow in the aquifer will be greatly aided by the low density and the low viscosity of gas. Gravity forces will cause gas to flow to the top of aquifiers where it will accumulate as a thin layer of relatively high saturation. Flow of gas in the thin layer will be greatly aided by the much lower viscosity of gas as compared with water. Production in accordance with the method of this invention will be accomplished most efficiently using wells distributed over the geographic area of the aquifer to minimize pressure differences in the aquifer. Optimum well spacing is dependent on well capacity, well cost, aquifer permeability, aquifer thickness, aquifer porosity, gas content of aquifer water, and several other considerations which will be apparent to those familiar with oil and/or gas production operations.

APPLICATION OF THE METHOD OF THE INVENTION TO A GULF COAST GEOPRESSURED AQUIFER

The production performance expected with depletion of a typical large Gulf Coast geopressured aquifer was calculated using material balance and flow calculation procedures. The aquifer is a water sand at a depth of 15,000 feet. The aquifer area is 300 square miles, thickness of the aquifer averages 300 feet, porosity average is 20 percent and permeability average 100 millidarcies. The aquifer contains 100 billion barrels of water at an inital pressure of 12,975 psi and temperature of 352° F. The water is saturated with hydrocarbon gas at 30 scf/B with the result that gas initially in place is 3 trillion cubic feet. Other properties assumed in the calculations are rock compressibility of $3\times10^{-6}$ psi$^{-1}$, water compressibility of $3\times10^{-6}$ psi$^{-1}$, and an initial formation volume factor for water of 1.0411.

The production performance predicted for this geopressured sand is shown in Table III, below. Note that the produced gas-water ratio declines until the gas saturation reaches the critical value of 3 percent at just below 3000 psig. Then the gas-water ratio increases rapidly with continued pressure decline. Production of 16.7 billion barrels of water or 16.7 percent of the water initially in place is required to lower the pressure to 500 psig. At 500 psig the total gas production is almost 1.5 trillion cubic feet (tcf) or 50 percent of the gas initially in place.

TABLE III

PRODUCTION PERFORMANCE PREDICTED FOR GEOPRESSURED WATER SAND

| Pressure psi | Gas Saturation Percent | Cumulative Water Production $10^9$ Bs | Cumulative Gas Production $10^9$ scf | Cumulative Gas Production Percent Gas Initially In Place | Gas Water Ratio Incremental scf/B | Gas Water Ratio Cumulative scf/B |
|---|---|---|---|---|---|---|
| 12975 | 0 | 0 | 0 | 0 | 0 | 0 |
| 12000 | 0.10 | 0.672 | 19.4 | 0.65 | 28.9 | 28.9 |
| 10000 | 0.35 | 2.072 | 56.28 | 1.88 | 26.3 | 27.2 |
| 8000 | 0.67 | 3.526 | 86.53 | 2.88 | 20.8 | 24.5 |
| 6000 | 1.12 | 5.098 | 111.97 | 3.73 | 16.2 | 22.0 |

TABLE III-continued

PRODUCTION PERFORMANCE PREDICTED FOR GEOPRESSURED WATER SAND

| Pressure psi | Gas Saturation Percent | Cumulative Water Production $10^9$ Bs | Cumulative Gas Production $10^9$ scf | Percent Gas Initially In Place | Gas Water Ratio Incremental scf/B | Gas Water Ratio Cumulative scf/B |
|---|---|---|---|---|---|---|
| 4000 | 1.97 | 7.010 | 134.07 | 4.47 | 11.6 | 19.1 |
| 3000 | 2.81 | 8.360 | 144.99 | 4.83 | 8.1 | 17.3 |
| 2500 | 3.42 | 9.203 | 171.89 | 5.73 | 31.9 | 18.7 |
| 2000 | 4.40 | 10.323 | 252.00 | 8.40 | 71.5 | 24.4 |
| 1500 | 5.55 | 11.734 | 462.54 | 15.42 | 149.2 | 39.4 |
| 1000 | 7.30 | 13.608 | 830.21 | 27.67 | 196.2 | 61.0 |
| 500 | 10.40 | 16.743 | 1497.6 | 49.92 | 212.8 | 89.4 |

Initially, water only (gas phase gas will not interfere with water flow) will flow into wells completed in the aquifer. The productivity index of a well in an aquifer with a damage factor of 2 will be 62 B/D/psi. Thus, wells in the aquifer will flow at substantial rates until pressure reaches about 7000 psig. Below 7000 psig lifting will be required. Flowing bottom hole pressures are summarized in Table IV, below, for several gas-water ratios and water production rates. Gas lift can be utilized efficiently to produce water until aquifer pressure approaches 3500 psi. Submersible centrifugal pumps are preferred to lift water at pressures below 3500 psi.

TABLE IV

FLOWING BOTTOM HOLE PRESSURES FOR GAS LIFTING WATER

| Water Rate B/D | Gas-Water Ratio scf/B | Flowing Bottom-Hole Pressure* - psi |
|---|---|---|
| 4000 | 250 | 4189 |
| 7000 | 250 | 4124 |
| 10000 | 250 | 4120 |
| 15000 | 250 | 4147 |
| 20000 | 250 | 4192 |
| 4000 | 500 | 3022 |
| 7000 | 500 | 2915 |
| 10000 | 500 | 2912 |
| 15000 | 500 | 2970 |
| 20000 | 500 | 3090 |
| 4000 | 1000 | 2162 |
| 7000 | 1000 | 2052 |
| 10000 | 1000 | 2062 |
| 15000 | 1000 | 2150 |
| 20000 | 1000 | 2402 |

*Flowing wellhead pressure = 100 psi, depth = 15000 feet. Flow is through 1.9 inch ID × 7.625 inch OD annulus.

It has been recognized heretofore that large volumes of gas exist in solution in aquifer waters and it has been proposed in the past that production can be obtained from this resource base by producing aquifer water to the surface and removing the solution gas. It has also been proposed that degassed water be returned to the aquifer to maintain pressure and displace water saturated with gas to the producing wells. No one, however, has heretofore proposed the method of production described and claimed herein in which aquifer pressure is reduced to levels below those previously contemplated and conditions created wherein gas phase gas will flow to the wells completed in the aquifer. In this manner gas which was originally in solution in all of the water in the aquifer is produced whereas the gas production heretofore proposed would all come from produced water only. Application of the method of the invention will result in production of a larger quantity of gas per barrel of water produced and thereby the cost per unit of gas produced will be substantially lower.

Changes and modifications may be made in the illustrative embodiments of the invention shown and described herein without departing from the scope of the invention as defined in the appended claims.

Having fully described the nature, operation, method, advantages and objects of our invention we claim:

1. A method for recovering gas from solution in aquifer waters of a normally pressured aquifer comprising the steps of:

lifting water from wells completed in said normally pressured aquifer until the pressure in said aquifer is reduced sufficiently to cause gas initially in solution in said aquifer to become mobile and to flow as a gaseous phase in said aquifer, said wells being producible only by lifting;

continuing to produce water from said wells to cause gas saturation to build up in excess of that required for gas to flow in gaseous phase to said wells; and producing said gaseous phase which has evolved from said water in said aquifer from said wells.

2. A method as recited in claim 1 in which substantially more gaseous phase gas is produced than the gas in solution in said water.

3. A method as recited in claim 2 in which said produced gas is separated from said water at the surface.

4. A method as recited in claim 3 in which substantially the only gas produced is that gas in solution in said water and said gaseous phase evolved from said water.

5. A method as recited in claim 1 including producing only said gaseous phase gas from one or more of said wells.

* * * * *